United States Patent [19]

Arbter

[11] Patent Number: 4,704,928

[45] Date of Patent: Nov. 10, 1987

[54] DEVICE FOR ALIGNING AND CUTTING LENGTHS OF MATERIAL

[75] Inventor: Conrad Arbter, Saal, Fed. Rep. of Germany

[73] Assignee: Pfaff Industriemaschinen GmbH, Fed. Rep. of Germany

[21] Appl. No.: 903,278

[22] Filed: Sep. 3, 1986

[30] Foreign Application Priority Data

Sep. 4, 1985 [DE] Fed. Rep. of Germany ..... 3531553

[51] Int. Cl.[4] ..... B26D 7/02; B26D 7/14

[52] U.S. Cl. ..... 83/175; 83/18; 83/208; 83/282; 83/31

[58] Field of Search ..... 83/175, 208, 282, 371, 83/18

[56] References Cited

U.S. PATENT DOCUMENTS 4,601,225 7/1986 Starnes et al. ..... 83/175

*Primary Examiner*—Donald R. Schran

*Attorney, Agent, or Firm*—McGlew and Tuttle

[57] ABSTRACT

A device for aligning and cutting lengths of terrycloth along the woof thread comprises two aligning ledges capable of movement relative to one another that can be lowered into the pileless rows of the length of material. The aligning ledges are connected each with one of two diagonally opposite joints of a parallelogram frame. On the two intervening joints is mounted a cutting device that operates transverse to the direction of feed of the length of material with a cutting plane that is always located exactly in the middle between the two aligning ledges.

7 Claims, 3 Drawing Figures

DEVICE FOR ALIGNING AND CUTTING LENGTHS OF MATERIAL

FIELD AND BACKGROUND OF THE INVENTION

This invention relates in particular to cutting devices for use in association with sewing machines and in particular to a new and useful device for aligning and cutting lengths of material which have thickened portions separated by thin portions.

The invention relates to a device for aligning and cutting lengths of material. A device of this kind is to be found in French Pat. No. 1,374,528. For aligning the pileless rows of lengths of terrycloth straight along the woof thread, the prior art device has two plates that can be pressed against the lengths of material, which plates can be moved in opposite directions to one another by means of a motor, two reciprocally meshing gears, and rods which are each connected to a gear. On each plate is an aligning ledge and a supporting ledge, both of which can be pivoted jointly, also in opposite directions, by means of an electromagnet. Between the two plates is a cutting device that operates transversely to the direction of feed of the length of material, with its cutting plane lying exactly in the plane of symmetry of the pair of ledges.

A sensor device that detects the thickness of the length of material is positioned ahead of the alignment and cutting station. With the aid of the signals produced by detection of the front and rear pile edges of a pileless row, making allowance for the distance between the sensor device and the cutting plane of the cutting device, the drive mechanisms of the two pairs of ledges and the two plates are controlled so that the plates and the pair of ledges engage with the length of material precisely at the point in time when the pileless row is exactly even with the cutting plane.

Thus, to achieve the desired result of cutting the length of material straight along the thread and exactly down the middle of a pileless row, with the prior art device it is necessary to have the alignment tools engage with the length of material precisely symmetrically to the desired cut line, for which purpose not only the aforementioned sensor device but also a cam wheel drivable at two different rpm speeds are required.

The invention provides simple means for aligning a length of terrycloth for cutting down the middle of a pileless row.

By reciprocal coupling of the paired aligning and supporting ledges and the support piece for the cutting device by means of a parallelogram frame, when the distance between the pairs of ledges changes, the support piece is always moved simultaneously half the change in distance. Since the cutting device is positioned on the support piece in such a way that its cutting plane is exactly in the center between the two pairs of ledges, this central position of the cutting device is maintained regardless of the distance between the two pairs of ledges. Because of this movement ratio, therefore, in order to accomplish the alignment, all that is required is to stop the length of material with the pileless row in the area of the two alignment ledges and to move the two pairs of ledges, before engagement with the length of material, so close to one another that the two aligning ledges set down into the pileless row. When the pairs of ledges are then moved away from one another until the aligning ledges lie right up against the pile edges and have in the aligned the length of material straight along the thread in the area of the pileless row, upon completion of alignment of the cutting plane of the cutting device is atuomatically situated precisely in the middle of the pileless row, so that cutting can take place immediately after alignment.

A further simplification is achieved in that only one pair of ledges is capable of movement paralled to the plane of the length of material. By performing the alignment movement with the front alignment ledge and front support ledge with respect to the direction of feed of the length of material, so that the alignment movement is counter to the direction of feed of the length of material, the additional advantage is gained that any shifting or wrinkling that may occur upon alignment occurs only in the segment of material lying on the supply side of the cutting line and is smoothed out again by the subsequent process of moving the length of material forward.

Accordingly it is an object of the invention to provide an improved device for centering a cuttng between two aligning ledges which are aligned with spaced apart edges of material so that the cutter will be centered between the aligning ledges for cutting the material between the edges with which the plates are aligned.

A further object of the invention is to provide a material cutting device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
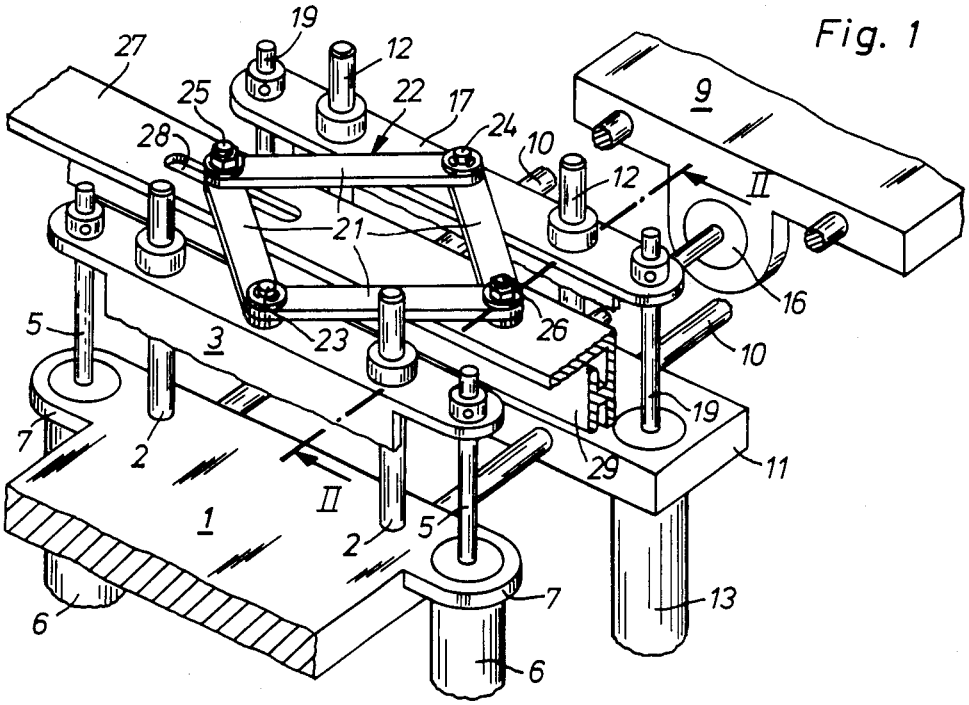
FIG. 1 is a partial top perspective view of a device for aligning and cutting material constructed in accordance with the invention.

Referring to the drawings in particular, the invention embodied therein comprises a device for aligning and cutting materials F which have two thickened portions separated by a thinner portion or base fabric W. The device includes first and second material bearing plates 1 and 11 which are mounted for movement toward and away from each other transversely in the feed direction A of the material F. Each plate 1 and 9 carries an aligning ledge or member 3 and 17 respectively which have aligning edges 4 and 18 which are advantageously positioned to engage the edge of each separated thickened portion so that a cutter 38 may cut the thin portion therebetween preferably along the cutting line centrally between the two edge portions. In accordance with the invention, this is accomplished by use of a parallogram frame 22 having links 21 of equal length which are pivotally interconnected and have opposing the joints 23 and 24 which are articulated to the aligning members of ledges 3 and 17 respectively, and opposite joints 25 and 26 which are articulated at spaced locations to a support piece 27. One of the joints 25 is confined in a slot 28 which extends lengthwise of the support piece 27 and the arrangement is such that when the bearing plates 1 and 11 are moved, the support piece is centered between the bearing plates. The support piece 27 carries the cutter 38 which may be arranged so that it cuts along a cutting line essentially between the edges 4 and 18. The cutting may be effected by movement of a cutter blade 32 with its associated motor 31 along a guideway 29 on a carriage 30.

Figure 2:
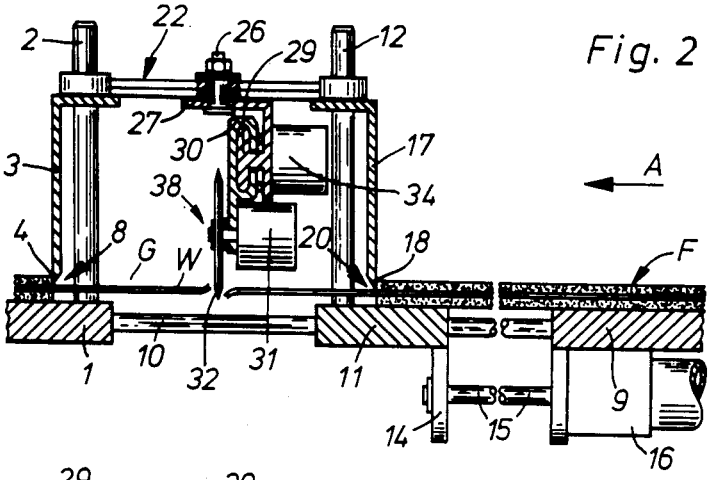
FIG. 2 is a sectional view taken along line II—II of FIG. 1.
Figure 3:
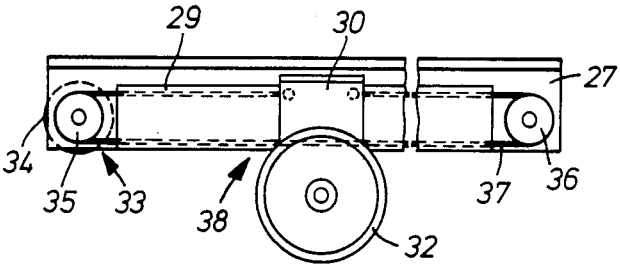
FIG. 3 is a view of the advance drive of the cutting device.

On the bearing plate 1 are mounted two vertical guide bars 2. On the guide bars 2 is slidably mounted the angular aligning ledge 3 that has the sharpened aligning edge 4 (FIG. 2). Both ends of the aligning ledge 3 are connected to piston rods 5 of two pneumatic or hydraulic cylinders 6 that are firmly attached to projections 7 of the bearing plate 1. The bearing plate 1 and the aligning ledge 3 together constitute a ledge pair 8 (FIG. 2).

Between the bearing plate 1 and an equally stationary bearing plate 9 are mounted two horizontal guide bars 10. On the guide bars 10 is slidably mounted the bearing plate 11 that supports two vertical guide bars 12 and two pneumatic or hydraulic cylinders 13. On a projection 14 of the bearing plate 11 is mounted the piston rod 15 of a pneumatic or hydraulic cylinder 16 that is firmly attached to the bottom of the bearing plate 9.

On the guide bars 12 is slidably mounted the angular aligning ledge 17 that has the sharpened aligning edge 18 (FIG. 2). The two ends of the aligning ledge 17 are firmly attached to piston rods 19 of the two pneumatic or hydraulic cylinders 13. The bearing plate 11 and the aligning ledge 17 together constitute a ledge pair 20.

The two ledge pairs 8, 20 are coupled together by the parallelogram frame 22 consisting of four links 21 of equal lengths, with the joint 23 connected with the aligning ledge 3 and the opposite joint 24 connected with the aligning ledge 17. On the two intervening joints 25, 26 of the parallelogram frame 22 is mounted the angular support piece 27, joint 25 being guided in an oblong slot 28 cut into the support piece 27.

The support piece 27 has a T-shaped guide rail 29. On the guide rail 29 is slidably mounted the carriage 30 bearing a motor 31 for the circular blade 32. In order to move the carriage 30 there is provided a belt drive 33, consisting of a motor 34, two pulleys 35, 36 and a belt 37, the upper track of the belt 37 being attached to the carriage 30. Components 30 through 37 constitute a cutting device 38.

The device works as follows:

For unhampered conveyance of the length of material F consisting of terrycloth, the aligning ledges 3, 17 are raised by means of the pneumatic or hydraulic cylinders 6, 13 and the carriage 30 with the circular blade 32 is moved back to a starting position to the side of the length of material F. In addition, the ledge pair 20 (FIG. 2) is moved by pneumatic or hydraulic cylinder 16 so far towards the ledge pair 8 that the distance between the aligning edges 4, 18 of the aligning ledges 3, 17 is narrower than the smallest possible width of the pileless rows G of the length of material F.

As soon as a pileless row G passes under the aligning ledges 3,17 and the length of material F is stopped, the aligning ledges 3, 17 are lowered into the pileless row G until the aligning edges 4, 18 touch the base fabric W. Then the ledge pair 20 is pushed back by pneumatic or hydraulic cylinder 16 counter to the direction of feed A of the length of material. In the course of this movement the aligning ledge 17 first comes into contact with the pile edge bordering one side of the pileless row, whereupon a more or less wide area of the length of material F depending on the thickness and flexibility of the material is shifted counter to its direction of feed A while there is simultaneous alignment straight along the woof thread. As the ledge pair 20 continues its movement, the aligning ledge 3 comes into contact with the other edge of the pile bordering the pileless row G. Now the base fabric W of the pileless row G is stretched between the two aligning ledges 3, 17 and in the process aligned straight along the woof along its entire area.

Since by the sliding of the ledge pair 20, the support piece 27 with the cutting device 38 thanks to the movement ratios of the parallelogram frame 22 always executes a movement half as large as that of the ledge pair 20, and the circular blade 32 is thus always precisely in the middle between the aligning edges 4, 18 of the two aligning ledges 3, 17,the cutting plane of the cutting device 38, which is determined by the path of movement of the circular blade 32, is automatically exactly in the center of the pileless row G at the end of the alignment movement.

After the alignment procedure is completed, the two motors 31, 34 are switched on, whereupon the circular blade 32 cuts through the length of material F transverse to the direction of feed A of the length of material.

While specific embodiments of the invention have been shown and described in detail to illustrate the application of the principles of the invention, it will be understood that the invention may be embodied otherwise without departing from such principles.

What is claimed:

1. A device for aligning and cutting material having at least two thickened material portions separated by a thin material portion and which material is fed in a feed direction, comprising first and second material bearing plates, means mounting said first and second plates for movement toward and away from each other parallel to the feed direction, first drive means connected to said plates for moving said plates relative to each other parallel to the feed direction, an aligning ledge carried by each of said bearing plates and having a substantially vertical aligning edge, means mounting each aligning ledge for movement upwardly and downwardly over each respective bearing plate for aligning said aligning ledge for engagement of its aligning edge with a respective thickened material portion, second drive means connected to each aligning ledge for moving said aligning ledge upwardly and downwardly with respect to its associated bearing plate, a support piece mounted between and above said first and second bearing plates, a parallelogram frame having first and second opposing joints connected to respective aligning ledges and third and fourth opposing joints connected at spaced locations to said support piece, and a cutting device mounted on said support piece in a position to cut the thin material position between said aligning ledges, said support piece being held by said paralelogram frame so that said cutting device is in a plane in the middle between the two aligning edges.

2. A device according to claim 7, wherein said parallelogram frame comprises four links of substantially equal length, one of said links being connected between said first and third opposing joints, one of said links being connected between said first and fourth opposing joints, one of said links being connected between said second and third opposing joints and one of said links being connected between said second and fourth opposing joints, at least one of said third and fourth opposing joints being mounted for movement along said support piece in a direction perpendicular to said feed direction, said cutting device being mounted to said support piece for movement in said direction which is perpendicular to said feed direction, said cutting device comprising a cutting blade lying in a plane containing said direction which is perpendicular to said feed direction whereby with movement of said aligning ledges in a direction away from each other, and with said aligning edges engaged with two thickened material portions which are separated by a thin material portion, said blade is in a central plane of the thin material portion by virtue of said parallelogram frame.

3. A device according to claim 1, wherein said support piece includes a guide member extending transverse to the feed direction, a carriage carrying said cutting device being movable along said guide, member said cutting device comprising a rotatable blade and a motor driving said blade.

4. A device according to claim 1, wherein said support piece includes an elongated slot enlongated in the direction parallel to said aligning edges, said parallelogram frame having a joint connection confined for movement in said slot.

5. A device according to claim 1, wherein said first and second drive means comprises a fluid pressure operated piston and cylinder combination.

6. A device for aligning and cutting straight along the woof thread lengths of material of a thickness varying in the direction of feed,such as terrycloth with pileless rows, with a cutting device operating transverse to the direction of feed of the length of material comprising two aligning ledges mounted for movement perpendicular to the plane of the length of material, two supporting ledges positioned opposite said aligning ledges on the other side of the length of material, at least one of said aligning ledges and the associated one of said supporting ledges being mounted for sliding parallel to the direction of travel of the length of material, a parallelogram having two opposing joints connected to the associated pairs of aligning and supporting ledges ad having two intervening joints and a support piece bearing the cutting device connected at spaced locations to said two intervening joints.

7. A device according to claim 6, wherein said parallelogram frame comprises four links of substantially equal length, one of said links being connected between said first and third opposing joints, one of said links being connected between said first and fourth opposing joints, one of said links being connected between said second and third opposing joints and one of said links being connected between said second and fourth opposing joints, at least one of said third and fourth opposing joints being mounted for movement along said support piece in a direction perpendicular to said feed direction, said cutting device being mounted to said support piece for movement in said direction which is perpendicular to said feed direction, said cutting device comprising a cutting blade lying in a plane containing said direction which is perpendicular to said feed direction whereby with movement of said aligning ledges in a direction away from each other, and with said aligning edges engaged with two thickened material portions which are separated by a thin material portion, said blade is in a central plane of the thin material portion by virtue of said parallelogram frame.

* * * * *